US009187978B2

(12) United States Patent
Castro

(10) Patent No.: US 9,187,978 B2
(45) Date of Patent: Nov. 17, 2015

(54) EXPANDABLE BALL SEAT FOR HYDRAULICALLY ACTUATING TOOLS

(71) Applicant: Candido Castro, Houston, TX (US)

(72) Inventor: Candido Castro, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 317 days.

(21) Appl. No.: 13/793,688

(22) Filed: Mar. 11, 2013

(65) Prior Publication Data

US 2014/0251629 A1 Sep. 11, 2014

(51) Int. Cl.
*E21B 34/14* (2006.01)
*E21B 34/00* (2006.01)

(52) U.S. Cl.
CPC ..... *E21B 34/14* (2013.01); *E21B 2034/002* (2013.01)

(58) Field of Classification Search
CPC ... E21B 34/14; E21B 2034/002; E21B 34/10; E21B 34/103; E21B 34/00
See application file for complete search history.

(56) References Cited

U.S. PATENT DOCUMENTS

| | | | |
|---|---|---|---|
| 3,054,415 | A | 9/1962 | Baker et al. |
| 4,099,563 | A | 7/1978 | Hutchison et al. |
| 4,520,870 | A | 6/1985 | Pringle |
| 4,889,199 | A | 12/1989 | Lee |
| 5,146,992 | A | 9/1992 | Baugh |
| 5,244,044 | A | 9/1993 | Henderson |
| 5,499,687 | A | 3/1996 | Lee |
| 5,960,884 | A | 10/1999 | Echols |
| 6,520,257 | B2 | 2/2003 | Allamon et al. |
| 6,634,428 | B2 | 10/2003 | Krauss et al. |
| 6,966,368 | B2 | 11/2005 | Farquhar |
| 7,322,417 | B2 | 1/2008 | Rytlewski et al. |
| 7,377,321 | B2 | 5/2008 | Rytlewski et al. |
| 7,416,029 | B2 | 8/2008 | Telfer et al. |
| 8,261,761 | B2 | 9/2012 | Gerrard et al. |
| 8,505,639 | B2 | 8/2013 | Robinson et al. |
| 2003/0024706 | A1 | 2/2003 | Allamon |
| 2004/0108109 | A1 | 6/2004 | Allamon et al. |
| 2008/0093080 | A1 | 4/2008 | Palmer et al. |
| 2011/0030968 | A1 | 2/2011 | Xu |

(Continued)

FOREIGN PATENT DOCUMENTS

| | | |
|---|---|---|
| CA | 2100389 | 1/1994 |
| EP | 2132406 B1 | 8/2010 |

(Continued)

OTHER PUBLICATIONS

Search Report and Written Opinion in counterpart PCT Appl. PCT/US2014/023103, dated Feb. 20, 2015.

*Primary Examiner* — Yong-Suk (Philip) Ro
(74) *Attorney, Agent, or Firm* — Blank Rome LLP

(57) ABSTRACT

A downhole tool has a housing, a mandrel, a seat, and a piston. The housing defines a first bore, and the mandrel is movably disposed in the first bore and defines a second bore. The mandrel has first and second mandrel sections or upper and lower cones, and the first mandrel section defines a cross-port communicating the second bore with an annular space between the mandrel and the housing. The seat is disposed in the first bore of the housing between the first and second mandrel sections. The seat is movable to a constricted state in the first bore to catch a dropped ball and is movable to an expanded state in the first bore to pass a dropped ball. The piston is disposed in the annular space and at least temporality supports the seat in its constricted state.

37 Claims, 6 Drawing Sheets

(56) References Cited

U.S. PATENT DOCUMENTS

| | | | | |
|---|---|---|---|---|
| 2011/0073321 | A1 | 3/2011 | Fay et al. | |
| 2011/0203800 | A1 | 8/2011 | Tinker et al. | |
| 2011/0240315 | A1 | 10/2011 | McNeilly | |
| 2011/0278017 | A1 | 11/2011 | Themig et al. | |
| 2013/0025868 | A1 | 1/2013 | Smith et al. | |
| 2013/0048298 | A1* | 2/2013 | Merron et al. | 166/373 |
| 2013/0161017 | A1* | 6/2013 | King | 166/318 |
| 2013/0284451 | A1* | 10/2013 | Merron | 166/373 |
| 2013/0299199 | A1* | 11/2013 | Naedler et al. | 166/386 |

FOREIGN PATENT DOCUMENTS

| | | | |
|---|---|---|---|
| GB | 2375558 | A | 11/2002 |
| RU | 2048226 | C1 | 11/1995 |
| WO | 99/47789 | A1 | 9/1999 |

* cited by examiner

EXPANDABLE BALL SEAT FOR HYDRAULICALLY ACTUATING TOOLS

BACKGROUND OF THE DISCLOSURE

In the completion of oil and gas wells, downhole tools are mounted on the end of a work string, such as a drill strings, a landing string, a completion string, or production string. The workstring can be any type of wellbore tubular, such as casing, liner, tubing, and the like. A common operation performed downhole temporarily obstructs the flow path within the wellbore to allow the internal pressure within a section of the workstring to be increased. In turn, the increased pressure operates hydraulically actuated tools. For example, a liner hanger can be hydraulically operated to hang a liner to well casing. In other examples, the increased pressure can hydraulically release a setting tool, washpipe, or a gravel pack inner string from a packer.

Sealably landing a ball on a ball seat provides a common way to temporarily block the flow path through a wellbore tubular so a hydraulic tool above the seat can be operated by an increase in pressure. Historically, segmented dogs or keys have been used create a ball seat for landing a ball. Alternatively, a hydro-trip mechanism can use collet fingers that deflect and create a ball seat for engaging a dropped ball. Segmented ball seats may be prone to fluid leakage and tend to require high pump rates to shear open the ball seat. Additionally, the segmented ball seat does not typically open to the full inner diameter of the downhole tubular so the ball seat may eventually need to be milled out with a milling operation.

Once the hydraulically actuated tool, such as a liner hanger or packer is actuated, operators want to remove the obstruction in the tubular's flow path. For example, operators will want to move the ball and seat out of the way. Various ways can be used to reopen the tubular to fluid flow.

In one example, with the ball landed on the seat, the increasing pressure above the ball seat eventually causes a shearable member holding the ball seat to shear, releasing the ball seat to move downhole with the ball. However, this may leave the ball and ball seat in the wellbore, potentially causing problems for subsequent operations.

In another way to reopen fluid flow through the tubular, increased pressure above the ball seat can eventually force the ball to deformably open the seat, which then allows the ball to pass through. In these designs, the outer diameter of the ball represents a maximum size of the opening that can be created through the ball seat. This potentially limits the size of subsequent equipment that can pass freely through the ball seat and further downhole without the risk of damage or obstruction.

Any of the hydraulic tools that are to be actuated and are located above the ball seat need to operate at a pressure below whatever pressure is needed to eventually open or release the ball seat. Internal pressures can become quite high when breaking circulation or circulating a liner through a tight section. To avoid premature operation of the tool at these times, the pressure required to open or release a ball seat needs to be high enough to allow for a sufficiently high activation pressure for the tool. For example, ball seats can be assembled to open or release at a predetermined pressure that can exceed 3000 psi.

Since the ball seat is a restriction in the wellbore, it must be opened up, moved out of the way, or located low enough in the well to not interfere with subsequent operations. Commonly, the ball seat is moved out of the way by having it drop down hole. Unfortunately, this may require the removal of both the ball and ball seat at a later time.

Ball seats may also be milled out of the tubular to reopen the flow path. For example, ball seats made of soft metals such as aluminum are easier to mill out; however, they may not properly seat the ball due to erosion caused by high volumes of drilling mud being pumped through the reduced diameter of the ball seat. Interference from the first ball seat being released downhole may also prevent the ball from sealably landing on another ball seat below.

One type of ball seat used in the art uses a collet-style mechanism that opens up in a radial direction when shifted past a larger diameter grove. However, these collet-style ball seats are more prone to leaking than a solid ball seats, and the open collet fingers exposed inside the tubular create the potential for damaging equipment used in subsequent wellbore operations.

The subject matter of the present disclosure is directed to overcoming, or at least reducing the effects of, one or more of the problems set forth above.

DETAILED DESCRIPTION OF THE DISCLOSURE

Figure 1:
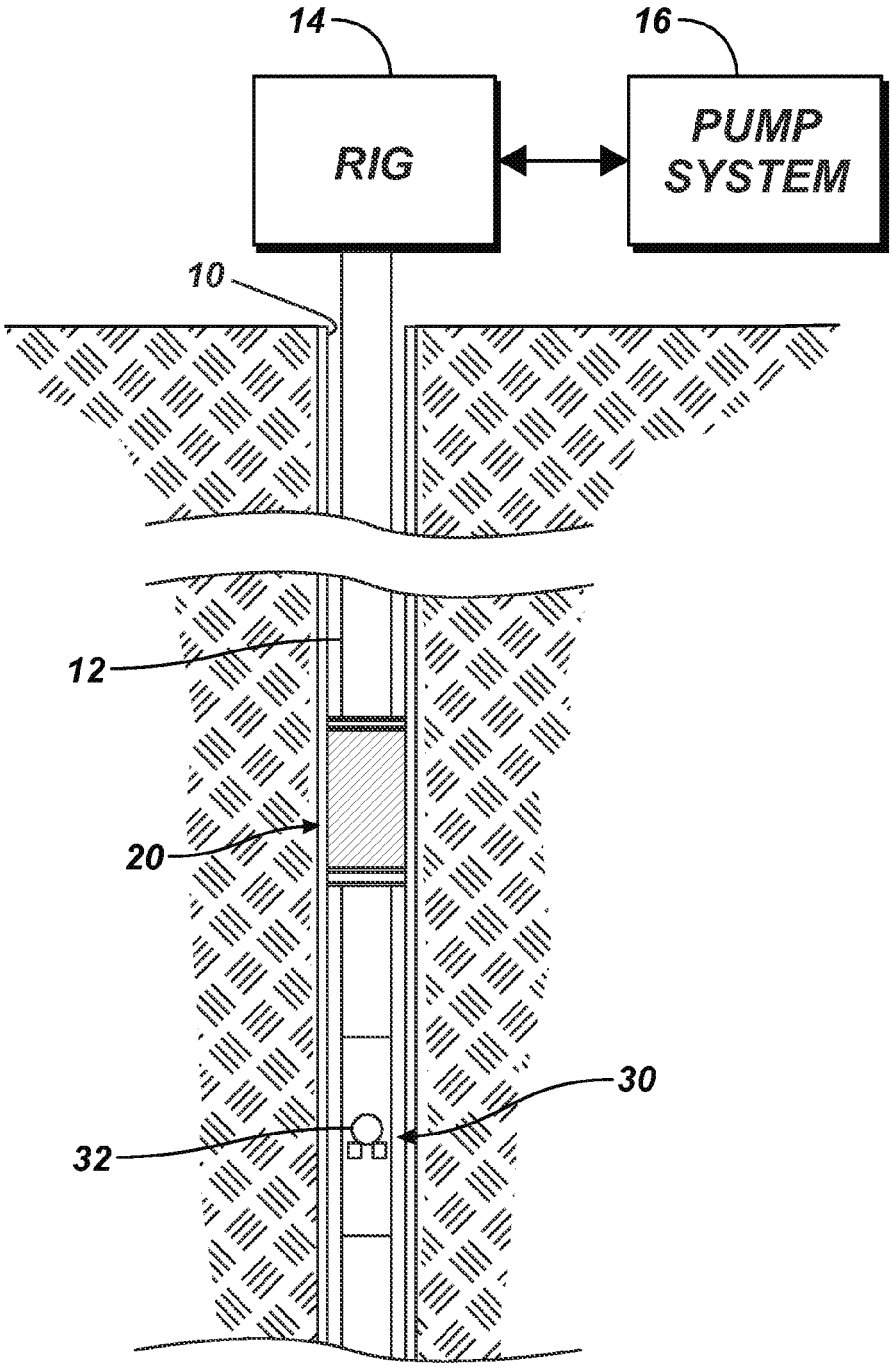
FIG. 1 illustrates a wellbore assembly having an expandable ball seat for actuating a hydraulically actuated tool.

FIG. 1 illustrates a wellbore tubular disposed in a wellbore. A hydraulically actuated tool 20, such as a packer, a liner hanger, or the like is disposed along the wellbore tubular 12 uphole from a downhole tool 30 having an expandable ball seat 32. The disclosed downhole tool 30 can be used to set the hydraulically actuated tool 20 and has the seat 32 that allows setting balls to pass therethrough.

When operators wish to actuate the hydraulically actuated tool 20, for instance, an appropriately sized ball is dropped from the rig 14 to engage in the seat 32 of the downhole tool 30. With the ball engaged in the seat 32, operators use the pumping system 16 to increase the pressure in the wellbore tubular 12 uphole from the tool 30. In turn, the increase tubing pressure actuates an appropriate mechanism in the hydraulically actuated tool 20 uphole of the ball seat 32. For example, the tool 20 may be a hydraulically set packer that has a piston or sleeve that compresses a packing element in response to the increased tubing pressure.

Once the tool 20 is actuated, operators will want to reopen fluid communication downhole by moving the seated ball out of the way. Rather than milling out the ball and seat, the seat 32 of the present disclosure allows operators to drop the ball further downhole.

Figure 2A:
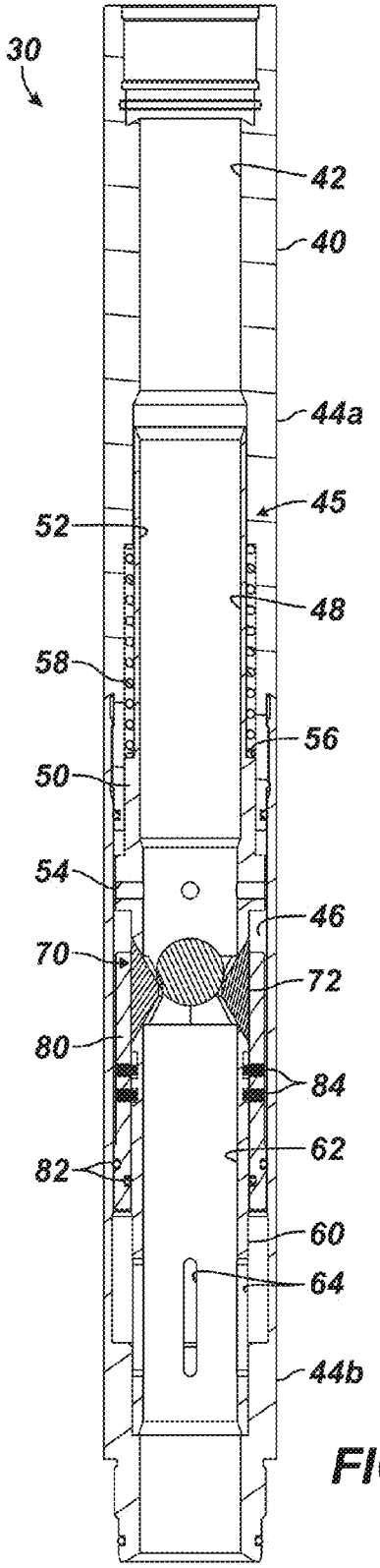
FIG. 2A illustrates a cross-sectional view of a downhole tool having an expandable ball seat according to the present disclosure in a run-in condition.
Figure 2B:
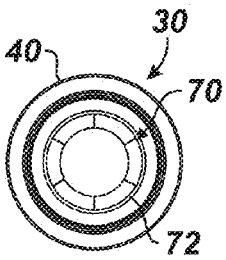
FIG. 2B illustrates an end view of the downhole tool.
Figure 3:
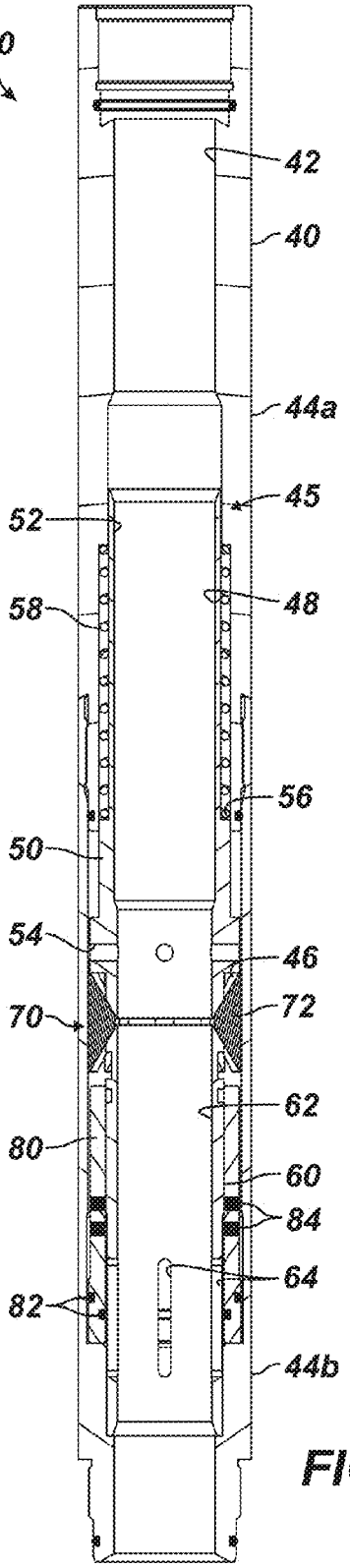
FIG. 3 illustrates the downhole tool with the expandable ball seat in a lock out condition.
Figure 4A:
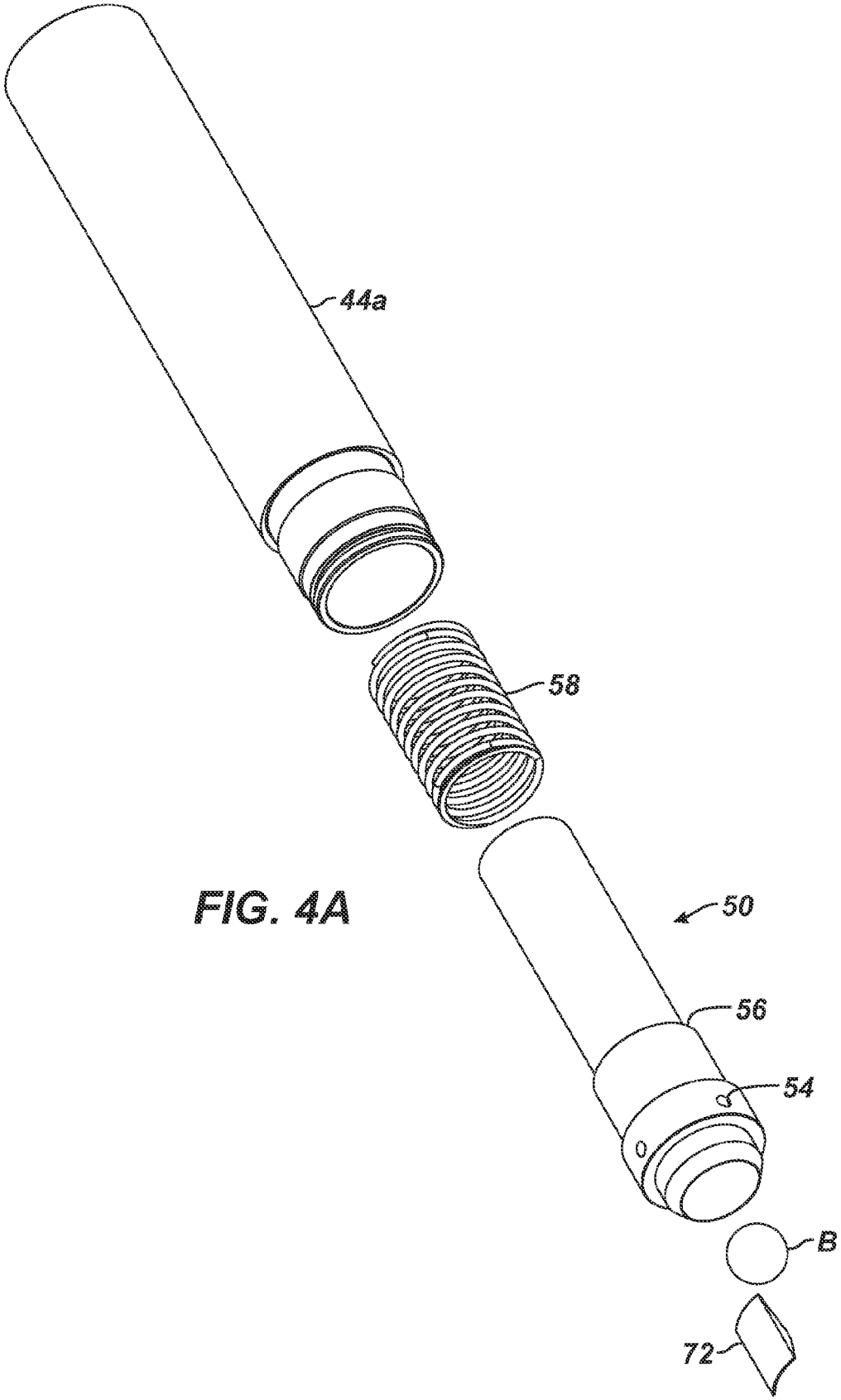
FIGS. 4A-4B illustrates perspective views of components of the downhole tool.
Figure 4B:
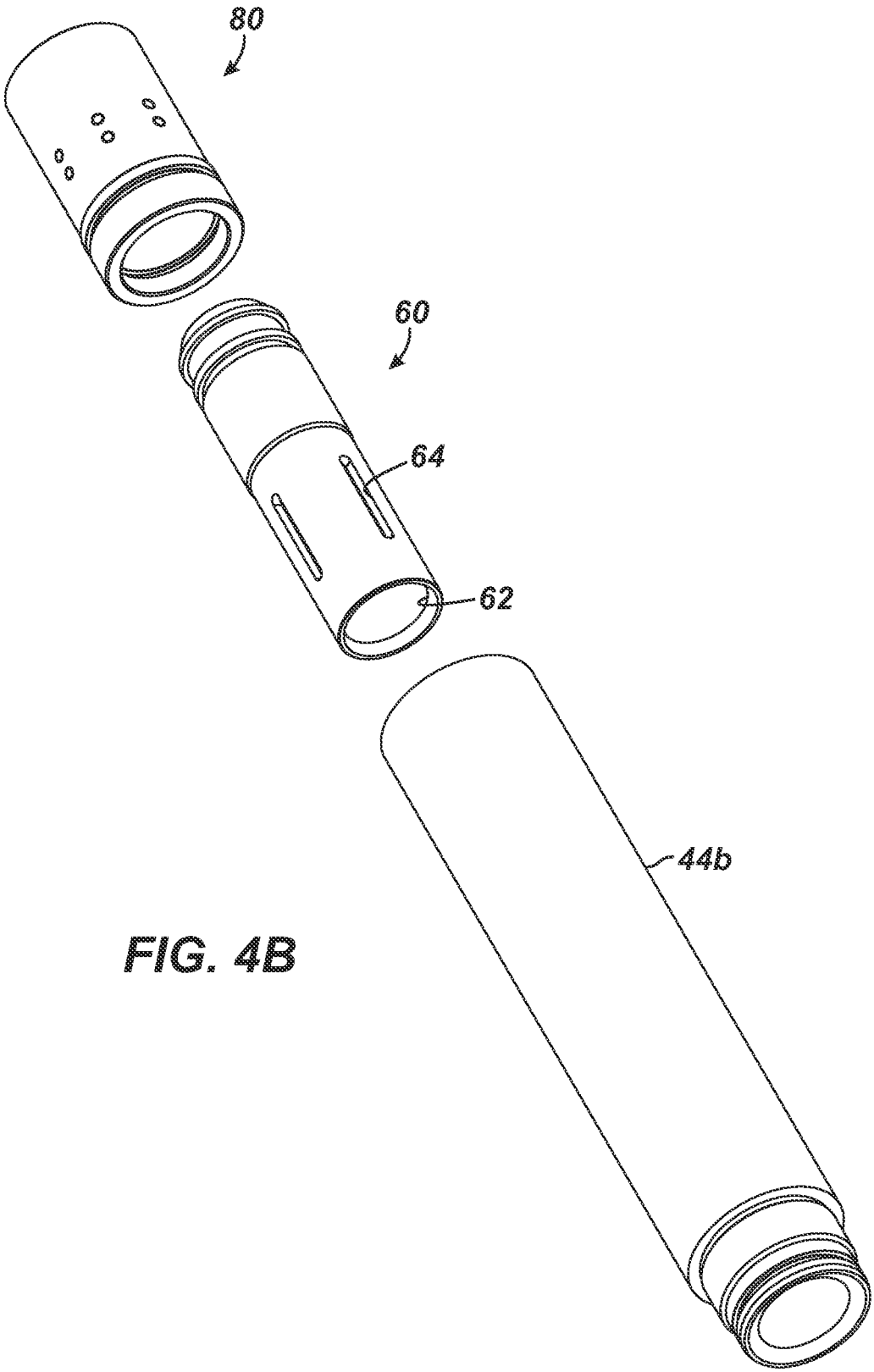

Turning now to more details of the downhole tool 30 having the expandable ball seat 32, FIG. 2A illustrates a cross-sectional view of the downhole tool 30 in a run-in condition, and FIG. 2B illustrates an end view of the downhole tool 30 with the ball seat 32 having the smallest inner diameter in this position. FIG. 3 illustrates a cross-sectional view of the downhole tool 30 in an open condition with the inner diameter of the ball seat 32 expanded to a larger inner diameter than the run-in position, and FIGS. 4A-4B show expanded views of the components of the downhole tool 30.

The downhole tool 30 includes an outer housing 40, which couples to sections of wellbore tubular (not shown) in a conventional manner, by threads, couplings, or the like. The housing 40 has upper and lower housing sections 44*a-b* that couple together for assembling the various internal components of the tool 30.

Inside the housing 40, the tool 30 has a mandrel 46 movably disposed in the bore 42 of the housing 40. The mandrel 46 defines another bore 48 therethrough and comprises first and second internal sleeves or mandrel sections 50 and 60. The tool 30 also includes a segmented seat 70 disposed in the housing's bore 42 between the mandrel sections 50 and 60. Finally, a piston 80 is movably disposed in an annular space 46 between the mandrel sections 50 and 60 and the housing 40, and a biasing element 58, such as a spring, biases the upper mandrel section 50 toward the segmented seat 70.

The upper mandrel section 50 defines an internal bore 52 with cross-ports 54 communicating outside the mandrel section 50 into the annular space 46. The lower mandrel section 60 defines fluid bypass ports 64 communicating the tool's annular space 46 with the section's bore 62. A shoulder 56 on the outside of the upper mandrel section 50 supports the spring 58.

In the run-in position shown in FIG. 2A, temporary connections 84, such as shear screws, hold the piston 80 in place to support segments 72 of the segmented seat 70 inward in the housing's bore 42. As shown in FIG. 2B, the segments 72 of the seat 70 in this constricted state create a restriction in the tool's bore 42 to catch a dropped ball and form a seal therewith. (Only one segment 72 is shown in FIG. 4A for simplicity.) In particular, FIG. 2A shows a dropped ball B landed on the constricted seat 70, which restricts fluid flow past the seat 70 and ball B. With the ball B seated in this manner, pressure can be built up to actuate any other hydraulically actuated tool uphole of the downhole tool 30.

Even though the ball B is seated, the applied pressure can communicate through the upper sections' cross-ports 54 and into the annular space 46 between the mandrel sections 50 and 60 and the housing 40. The applied pressure in th is space 46 can thereby act against the piston 80. Seals 82, such as O-rings, preferably seal the piston 80 inside the annular space 46 and engage inside the housing 40 and outside the mandrel section 60. This prevents premature flow from the annular space 46 past the sealed piston 80 and out the lower bypass ports 64 in the lower mandrel section 60.

As long as the applied pressure is less than the pressure needed to break the shear screws 84, the piston 80 remains in place and supports the segmented seat 70 constricted inward to support the ball B. At a predetermined pressure that is preferably higher than the actuating pressure of other tools, the applied pressure acting against the piston 80 breaks the shear screws 84.

As shown in FIG. 3, the freed piston 80 is forced downward in the annular space 46 by the applied pressure. Now without the support of the piston 80, the segmented seat 70 can expand outward to an expanded state by the applied pressure on the ball B, which is then released to pass out of the tool 30. As shown in FIG. 3, the lower fluid bypass ports 64 are elongated so that the piston 80 is no longer sealed in the annular space 46 when the piston 80 shears free and moves down. In this way, fluid pressure will not act on the piston 80 to cause it to move once the segmented seat 70 is opened.

Because the seat 70 is no longer supported by the piston 80, the spring 58 forcing the upper mandrel section downward toward the seat 70 causes the seat to expand outward into the annular space 46. The triangular cross-section of the seat's segments 72 along with the angled ends or upper and lower cones of the mandrel sections 50 and 60 can facilitate this movement.

Previous embodiments have discussed using the segmented ball seat 70 in a downhole tool 30 that is separate from any hydraulically actuated tool 20 disposed on a wellbore tubular 12. In other embodiments, the segmented ball seat 70 can actually be incorporated into a hydraulically-actuated tool, such as a packer, a liner hanger, or the like. In fact, the segmented ball seat 70 can actually be used directly as a part of the hydraulically actuating mechanism of such a tool.

Figure 5A:
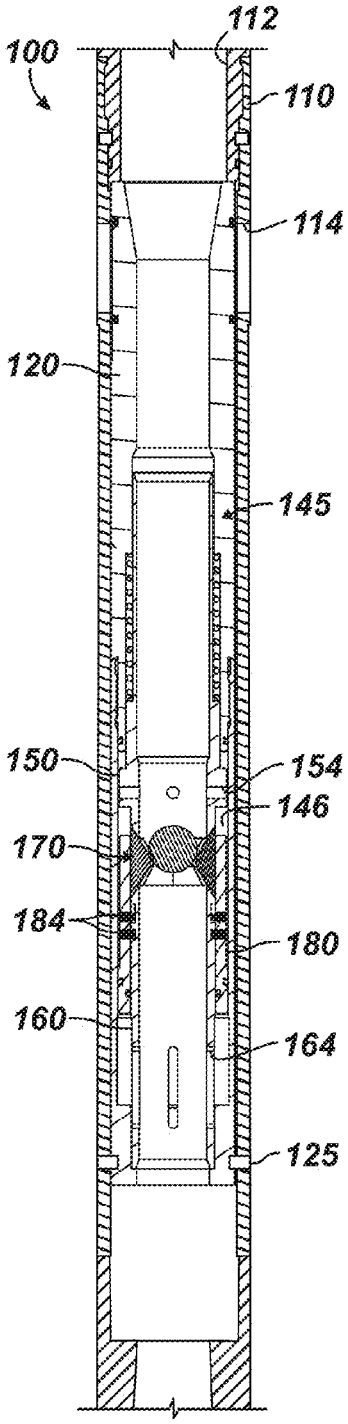
FIGS. 5A-5C illustrate cross-sectional views of a sliding sleeve in closed and opened conditions having an expandable ball seat according to the present disclosure.
Figure 5B:
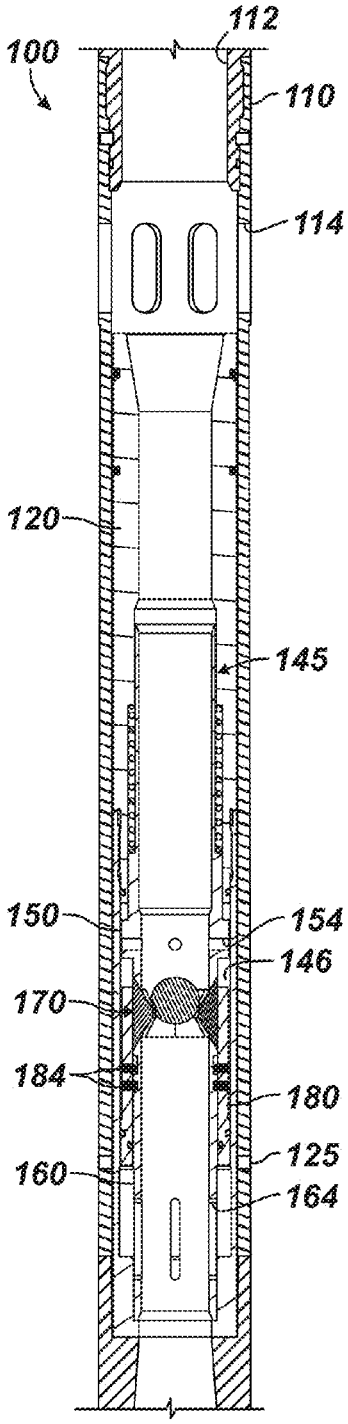
Figure 5C:
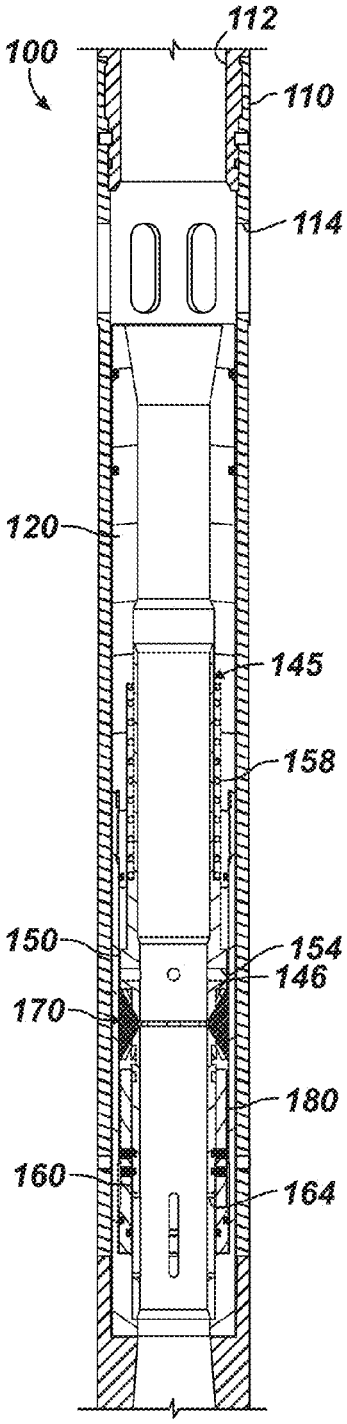

As one particular example, a sliding sleeve can incorporate the segmented ball seat of the present disclosure as part of its mechanism for hydraulically opening the sliding sleeve for fracture treatments or other operations. For instance, FIGS. 5A-5C show a sliding sleeve 100 in closed and opened states. The sliding sleeve 100 has a tool housing 110 defining one or more ports 114 communicating the housing's bore 112 outside the sleeve 100. An inner sleeve 120 is movably disposed in the tool's bore 112 and covers the ports 114 when the inner sleeve 120 is in a closed condition, as shown in FIG. 5A. Similar to the tool discussed previously, the sliding sleeve 100 has comparable components of upper and lower mandrel sections 150 and 160, biasing element 156, segmented ball seat 170, piston 180, shear screws 184, and other like components. Rather than being incorporated into a housing as in previous embodiments, these components are incorporated in the inner sleeve 120 of the sliding sleeve 100.

A dropped ball B engages in the segmented ball seat 170 that is incorporated into the inner sleeve 120. Pressure applied against the seated ball B eventually shears a set of first shear pins 125 or other breakable connections that hold the inner sleeve 120 in place in the housing's bore 112. Now free to move, the inner sleeve 120 moves with the applied pressure in the bore 112 against a lower shoulder and exposes the housings ports 114, as shown in FIG. 5B. Fluid treatment, such as fracturing, can then be performed to the annulus surrounding the sliding sleeve 100.

When it is then desired to open the segmented ball seat 170, additional pressure applied against the seated ball B, such as during the elevated pressures of a fracture treatment, can eventually act through the cross-ports 154 in the upper mandrel section 150 and into the annular space 146 where the pressure can act against the piston 180. Eventually, when a predetermined pressure level is reached, the shear screws 184 or other breakable connections can break so that the applied pressure moves the piston 180. As before, without the support of the piston 180, the segmented seat 170 can expand outward to an expanded state by the pressure on the ball B, which is then released to pass out of the sliding sleeve 100, as shown in FIG. 5C.

In the above discussion, the shear pins 125 holding the sleeve 120 have a lower pressure setting than the shear pins 184 holding the seat's piston 180. This allows the sleeve 120 to open with pressure applied against the seat 170 while the seat's piston 180 remains in its initial state. Eventual pressure can then break the shear pins 184 for the piston 180 so the seat 170 can pass the ball B.

Figure 6:
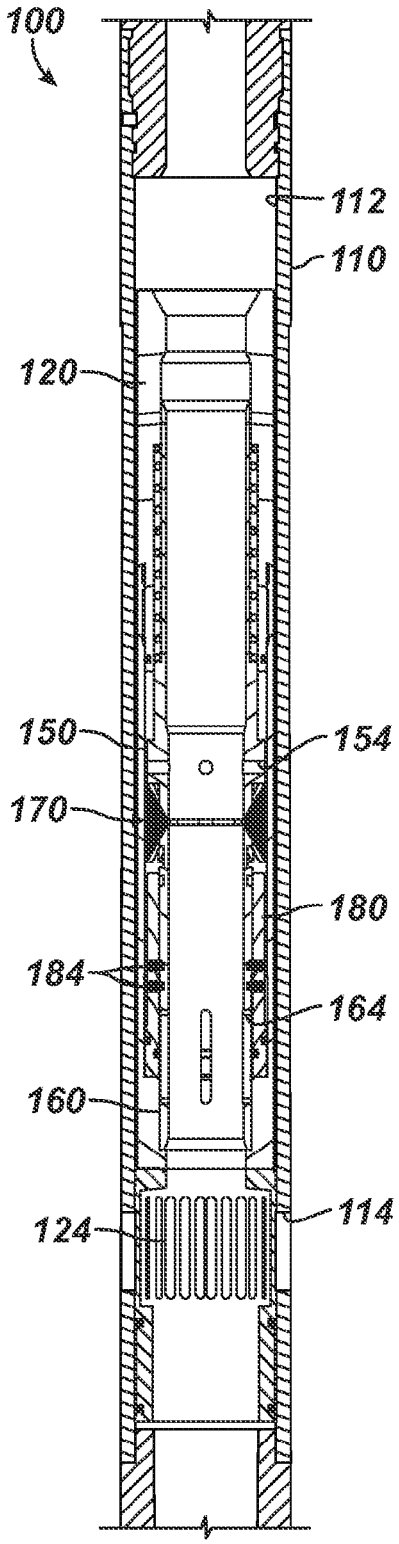
FIG. 6 illustrates cross-sectional view of another sliding sleeve in an opened condition having an expandable ball seat according to the present disclosure.

Although the external ports 114 for the sliding sleeve 100 are disposed uphole of the segmented ball seat 170 in FIGS. 5A-5C, an opposite arrangement can be provided, as shown in FIG. 6. Here, the inner sleeve 120 has slots 124 that align with the housing ports 114 disposed downhole from the seat 170 when the inner sleeve 120 is moved downhole in the tool's housing 110. The other components of this configuration can be essentially the same as those described previously.

The foregoing description of preferred and other embodiments is not intended to limit or restrict the scope or applicability of the inventive concepts conceived of by the Applicants. For example, the segments 72 of the seat 70 have been disclosed as having a triangular cross-section because this shape can facilitate the wedging of the segments 72 into the annular space 46 when unsupported by the piston 80 and moved by the biased upper mandrel section 50. Other shapes could be used. Moreover, the seat 70 need not be composed of completely separate segments 72 as implied above. Instead, the seat 70 can be a continuous component that is generally expandable and constrictable to either open or close its internal diameter and the resulting restriction inside the tool. The seat 70 can be composed of any suitable material, including metal, cast iron, elastomer, etc.

In another example, although the piston 80 as disclosed above is temporarily connected to the lower mandrel section 60 with shear screws 84, other temporary connections can be used. For example, a frangible support may be disposed in the annular space 46 downhole of the piston 80 to support the piston 80 against an internal shoulder of the housing 40. Alternatively, the piston 80 can be temporarily connected to the housing 40 by shear screws or other connection. These and other variations will be appreciated with the benefit of the present disclosure.

In additional alternatives, rather than having a biasing element 158 bias the upper mandrel section 50 so it can expand out the seat 70 when the support of the piston 80 is removed, the seat 70 itself can having a biasing element or elements to expand the seat 70 outward. Yet, it is still preferred that the upper mandrel section 50 moves downhole with the expansion of the seat 70 as this helps hide the segmented seat 70 inside the tool 30 so the bores 52 and 62 of the mandrel sections 50 and 60 can complete the bore 42 of the housing 40.

It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool, comprising:

a housing for use downhole defining a first bore;

a mandrel disposed in the first bore and defining a second bore, the mandrel having first and second mandrel sections, the first mandrel section defining a first cross-port for communicating fluid in the second bore with an annular space between the mandrel and the housing;

a seat disposed in the first bore of the housing between the first and second mandrel sections, the seat movable to a constricted state in the first bore and movable to an expanded state in the first bore; and a piston disposed in the annular space, the piston in a first position at least temporality supporting the seat in the constricted state, the piston movable in response to the communicated fluid to a second position removing the at least temporary support of the seat.

2. The tool of claim 1, further comprising a connection at least temporarily affixing the piston to the second mandrel section.

3. The tool of claim 1, wherein the seat comprises a plurality of segments circumferentially arranged around the first bore.

4. The tool of claim 3, wherein each of the segments defines a triangular cross-section.

5. The tool of claim 1, wherein the first mandrel section is movably disposed in the first bore toward the seat from a third position with the seat in the constricted state to a fourth position with the seat in the expanded state.

6. The tool of claim 5, further comprising a biasing element disposed in the annular space and biasing the first mandrel section toward the seat.

7. The tool of claim 1, wherein the second mandrel sections defines a second cross-port communicating the second bore with the annular space.

8. The tool of claim 1, wherein the piston sealably engages in the annular space against an inside of the first bore and an outside of the second mandrel section.

9. The tool of claim 8, wherein the second mandrel sections defines a second cross-port communicating the second bore with the annular space, the piston in the second position moved adjacent the second cross-port and being unsealed in the annular space.

10. The tool of claim 1, wherein the first mandrel section moved away from the second mandrel section permits movement of the seat to the constricted state.

11. The tool of claim 10, wherein the first mandrel section moved toward the second mandrel section moves the seat toward the expanded state.

12. The tool of claim 1, wherein the seat in the constricted state engages a ball dropped in the first bore.

13. The tool of claim 1, wherein the seat in the expanded state passes a ball dropped in the first bore.

14. The tool of claim 1, wherein the housing is an inner sleeve movably disposed in a main bore of the tool, the inner sleeve as the housing having the mandrel, the seat, and the piston.

15. The tool of claim 14, wherein the tool defines a port communicating the main bore outside the tool, and wherein the inner sleeve is movable in the main bore between open and closed conditions relative to the port.

16. The tool of claim 14, further comprising a first connection at least temporarily holding the inner sleeve in the tool.

17. The tool of claim 16, further comprising a second connection at least temporarily holding the piston supporting the seat.

18. The tool of claim 17, wherein the first connection is configured to break at a lower pressure than the second connection.

19. A downhole tool, comprising:

a housing for use downhole defining a first bore;

a mandrel disposed in the first bore and defining a second bore, the mandrel having first and second mandrel sections, the first mandrel section defining a first cross-port for communicating fluid in the second bore with an annular space between the mandrel and the housing;

a seat disposed in the first bore of the housing between the first and second mandrel sections, the seat movable from a constricted state to an expanded state in the first bore; and a piston at least temporarily held in place in the annular space and movable in the annular space from a first position to a second position in response to the communicated fluid, the piston in the first position supporting the seat in the constricted state, the piston in the second position moved away from supporting the seat in the constricted state.

20. The tool of claim 19, wherein a connection at least temporarily holds the piston in the first position.

21. The tool of claim 19, wherein the seat comprises a plurality of segments circumferentially arranged around the first bore.

22. The tool of claim 19, wherein the first mandrel section is movable disposed in the first bore toward the seat from a third position to a fourth position.

23. The tool of claim 22, wherein the first mandrel section in the third position permits the seat in the constricted state; and wherein the first mandrel section in the fourth position holds the seat toward the expanded state.

24. The tool of claim 22, further comprising a biasing element disposed in the annular space and biasing the first mandrel section toward the fourth position.

25. The tool of claim 19, wherein the piston sealably engages in the annular space against an inside of the first bore and an outside of the second mandrel section; and wherein the second mandrel section defines a second cross-port communicating the second bore with the annular space, the piston in the second position moved toward the second cross-port.

26. The tool of claim 19, wherein the seat in the constricted state engages an object in the second bore of the mandrel; and wherein the seat in the expanded state releases the object.

27. The tool of claim 19, wherein the housing is an inner sleeve movably disposed in a main bore of the tool, the inner sleeve as the housing having the mandrel, the seat, and the piston; wherein the tool defines a main port communicating the main bore outside the tool; and wherein the inner sleeve is movable in the main bore between open and closed conditions relative to the port.

28. The tool of claim 27, further comprising:

a first connection at least temporarily holding the inner sleeve in the tool;

a second connection at least temporarily holding the piston supporting the seat, wherein the first connection is configured is configured to release the inner sleeve at a lower threshold than the second connection is configured to release the piston.

29. A downhole tool actuated by an object, the tool comprising:

a housing for use downhole defining an inner bore, a first inner port, and an inner space, the inner bore passing through the housing, the space disposed in the housing separate from the inner bore, the first inner port communicating the inner bore with the inner space and communicating fluid in the inner bore and the inner space;

a seat disposed in the housing and exposed to the inner bore and the inner space, the seat at least movable from a first state for engaging the object in the inner bore to a second state for passing the object in the inner bore; and a piston disposed in the inner space, the piston in a first position at least temporarily supporting the seat in the first state, the piston movable in response to the communicated fluid to a second position removing the at least temporary support of the seat.

30. The tool of claim 29, further comprising a connection at least temporarily holding the piston in the first position.

31. The tool of claim 29, wherein the seat comprises a plurality of segments circumferentially arranged around the inner bore.

32. The tool of claim 29, wherein the housing comprises a mandrel disposed in a first bore of the housing and forming the inner space with the first bore of the housing, the mandrel defining the inner bore and the first inner port.

33. The tool of claim 32, wherein the mandrel comprises first and second mandrel sections having the seat disposed therebetween, the first mandrel section movable in the first bore of the housing, the second mandrel section affixed in the first bore of the housing.

34. The tool of claim 33, further comprising a biasing element disposed in the inner space and biasing the first mandrel section toward the seat.

35. The tool of claim 29, wherein the piston sealably engages in the inner space; and wherein the housing defines a second inner port communicating the inner bore with the inner space, the piston in the second position moved toward the second inner port.

36. The tool of claim 29, wherein the housing is an inner sleeve movably disposed in a main bore of the tool; wherein the tool defines a main port communicating the main bore outside the tool; and wherein the inner sleeve is movable in the main bore between open and closed conditions relative to the port.

37. The tool of claim 36, further comprising:

a first connection at least temporarily holding the inner sleeve in the tool; and a second connection at least temporarily holding the piston supporting the seat, wherein the first connection is configured to release the inner sleeve at a lower threshold than the second connection is configured to release the piston.

* * * * *